United States Patent [19]

Loch

[11] 4,346,128

[45] Aug. 24, 1982

[54] TANK PROCESS FOR PLATING ALUMINUM SUBSTRATES INCLUDING POROUS ALUMINUM CASTINGS

[75] Inventor: David M. Loch, Seattle, Wash.

[73] Assignee: The Boeing Company, Seattle, Wash.

[21] Appl. No.: 265,099

[22] Filed: May 19, 1981

Related U.S. Application Data

[63] Continuation-in-part of Ser. No. 135,679, Mar. 31, 1980, abandoned.

[51] Int. Cl.[3] ..... C23C 3/02

[52] U.S. Cl. ..... 427/328; 427/405; 427/406; 427/436; 427/438

[58] Field of Search ..... 427/436, 406, 438, 437, 427/328, 405

[56] References Cited

U.S. PATENT DOCUMENTS

| | | | |
|---|---|---|---|
| 3,180,715 | 4/1965 | Simon | 427/437 |
| 3,281,266 | 10/1966 | Colonel | 427/438 |
| 3,466,156 | 9/1969 | Peters et al. | 427/438 |
| 3,738,818 | 6/1973 | Stone et al. | 427/438 |

*Primary Examiner*—Ralph S. Kendall

*Attorney, Agent, or Firm*—Hughes, Barnard & Cassidy

[57] ABSTRACT

An improved tank process for plating aluminum substrates which is especially advantageous for plating porous aluminum castings and, blister-free plated aluminum substrates produced thereby, characterized in that the aluminum piece parts are: (i) emulsion cleaned in a room temperature alkaline cleaner; (ii) immersed in a room temperature dilute acid, inorganic, fluoride salt solution to dissolve heavy oxides and surface silicon while minimizing etching and intergranular attack of the aluminum substrate such, for example, as a porous cast aluminum substrate; (iii) immersed in a room temperature dilute zincate bath for applying a relatively thin zinc protective coating, preferably utilizing a double zincate immersion process with an intermediate prolonged (1–3 min.) nitric acid soak to reduce the zincate deposition rate and to thereby provide improved zincate adhesion; (iv) plated with a non-porous strike applied directly on the zincate protective coating—e.g., by electroplating or by electroless plating methods such, for example, as by immersion in a bath of nickle-hypophosphite material maintained at a temperature of approximately 190° F.; and (v), immersed in a metal plating bath such, for example, as a tin plating bath—preferably, a low pH, room temperature acid tin bath—so as to apply a blister-free electrically conductive surface on the porous aluminum casting.

18 Claims, 24 Drawing Figures

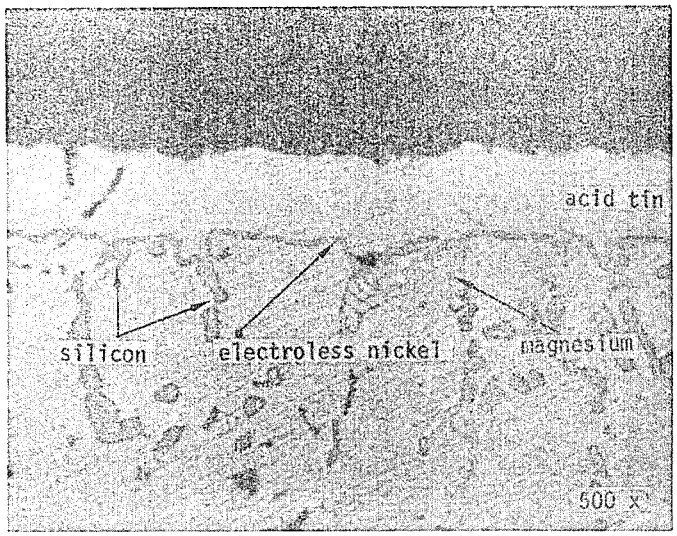
FIG. 13
FIG. 14
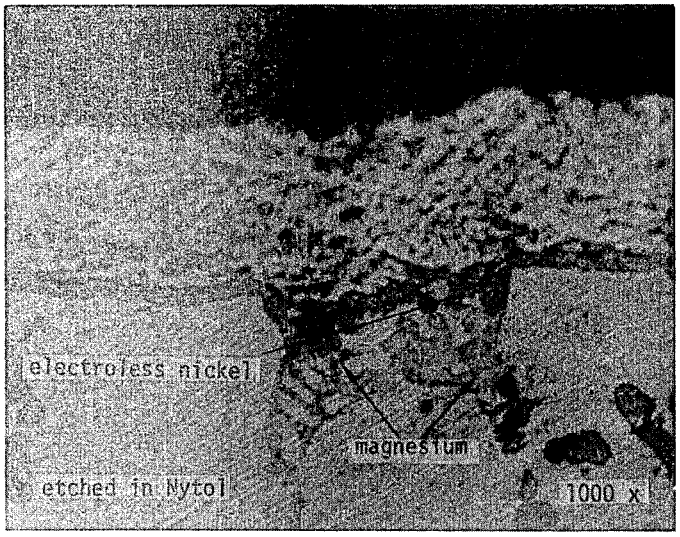
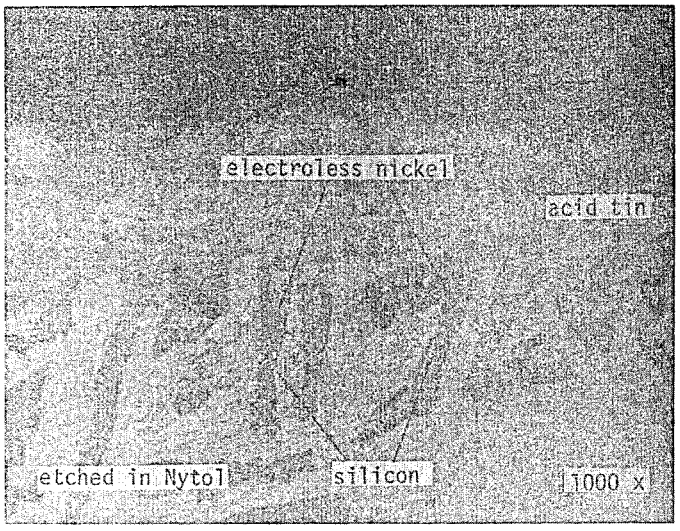
FIG. 15

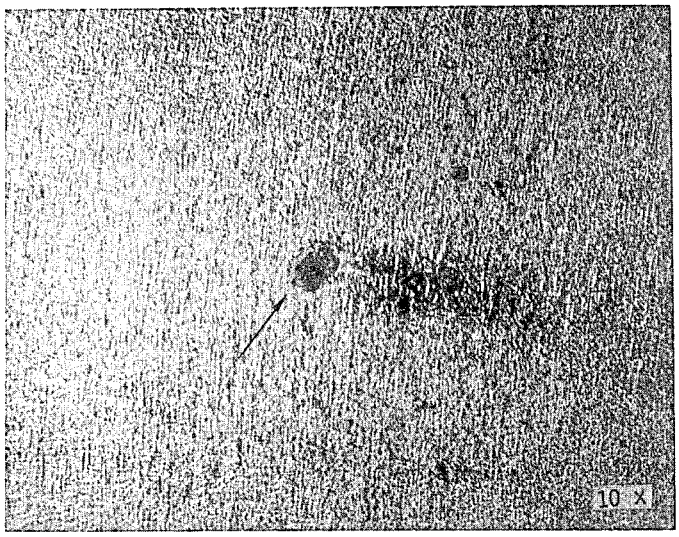
FIG. 19
FIG. 20
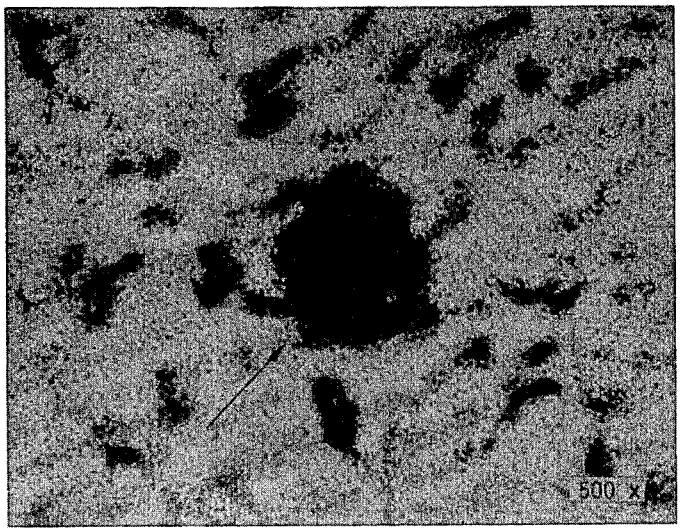

FIG. 23
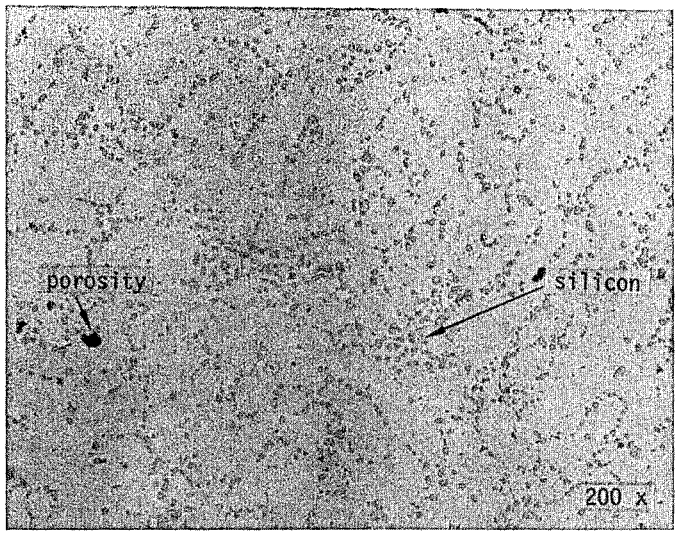
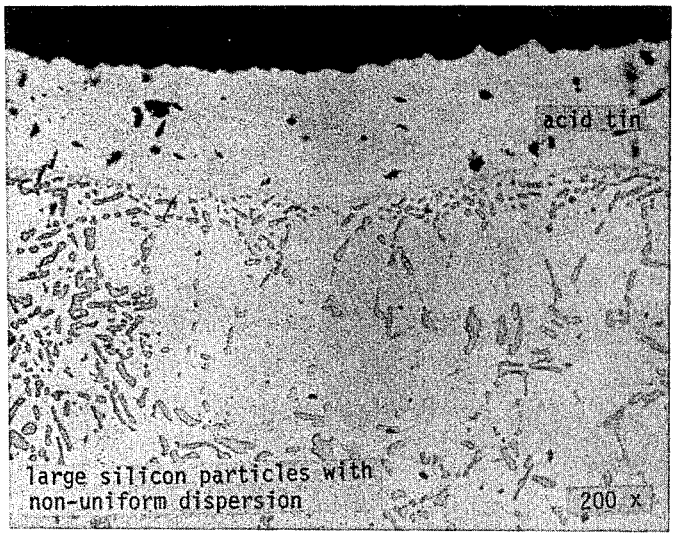
FIG. 24

TANK PROCESS FOR PLATING ALUMINUM SUBSTRATES INCLUDING POROUS ALUMINUM CASTINGS

The Government has rights in this invention pursuant to Contract No. N00019-78-C-0195 awarded by the United States Navy.

RELATED APPLICATION

This application is a continuation-in-part application based in part on applicant's co-pending application Ser. No. 135,679, filed Mar. 31, 1980, now abandoned for "Tank Process For Plating Aluminum Substrates Including Porous Aluminum Castings, And Plated Aluminum Substrates Produced Thereby."

BACKGROUND OF THE INVENTION

The present invention relates generally to an improved tank process for plating aluminum piece parts such, *for example,* as porous aluminum castings and, to blister-free plated aluminum substrates produced thereby; and, more particularly, to an improved process, and improved products produced thereby, for plating aluminum substrates with an electrically conductive surface—such, *for example,* as tin plate—wherein the plating deposit is securely bonded to the aluminum substrate, even where the substrate comprises a porous aluminum casting, with excellent adhesion properties throughout substantially the entire surface area of the substrate to be plated in a substantially blister-free state and, wherein the plating is not subject to separation and/or flaking and possesses improved corrosion-resistance relative to the bare substrate. In its more detailed aspects, the present invention relates to an improved process for forming essentially blister-free plated aluminum substrates, including plated porous aluminum castings, at relatively high production rates when compared with conventional plating techniques; yet, wherein the process yield rates of acceptable quality product are relatively high—viz., yield rates approaching 100%—irrespective of whether the aluminum casting microstructure is of premium quality or inferior quality.

Aluminum castings—including both sand and investment castings—are, subject to the limitations noted below, highly advantageous and desirable for usage in a wide range of product and/or industrial applications, not only because of their strength and light-weight characteristics but, also, because processes permit economical manufacture of even complex structural configurations. However, severe constraints have theretofore been placed on the extent of usage of aluminum castings as a direct result of their poor corrosion resistance characteristics, as well as the fact that such castings tend to spontaneously form non-conductive surface oxides which diminish the electrical conductivity of the casting. Moreover, in those instances where the plated aluminum product is to be used for electrical hardware, it is necessary that the plated substrate exhibit low electrical contact resistance between the substrate and the outermost plating deposited thereon. Sometimes special annodizing processes are used to generate a relatively thick and porous oxide film on the substrate to provide mechanical keying of the subsequent plating deposits. Although adhesion may be good, the oxide layer is non-conductive between the substrate and the outermost plating deposited thereon. Consequently, such special annodizing processes have proven unsatisfactory when attempting to plate aluminum substrates for usage in electrical hardware applications, principally because of their failure to meet the critical requirement of a low resistance interface between the substrate and the outer conductive metal plating deposited thereon.

For these reasons, there has been, and continues to be, an urgent demand for an effective plating process for porous aluminum castings. However, prior to the advent of the present invention, there has been no known, effective and reliable process for consistently depositing other metals on the surface of a porous aluminum casting with good adhesion properties, in a substantially blister-free state and, in those instances where the plated product is to be used for electrical hardware, with a low resistance interface between the substrate and the outer conductive metal layer deposited thereon.

The problems with plating aluminum and alloys thereof have long been recognized by persons skilled in the electroplating industry. *For example,* as recognized by S. Wernick and R. Pinner, *The Surface Treatment and Finishing of Aluminum and Its Alloys,* 4th Edition, Vol. 2, at page 871 (Published by Robert Draper, Ltd.), aluminum and aluminum alloys are subject to spontaneous formation of oxide coatings which tend to hinder adhesion of subsequent deposits. Because of the amphoteric nature of the oxide produced, the reactions likely to occur in the process are complicated, thereby reducing process reliability. Moreover, the electropositive nature of aluminum and its alloys serves to promote formation of low adhesion deposits. And, since the coefficient of expansion of aluminum differs substantially from those metals which are commonly deposited on it during a plating process, the plated casting has heretofore been advantageously used only in environmental conditions wherein temperature changes are of minimal magnitude—otherwise, differential expansion between the aluminum substrate and the plating deposited thereon can cause sufficient strain to rupture the bond between the substrate and the plating.

In addition to the foregoing problems which are inherent when attempting to plate aluminum and aluminum alloys, those skilled in the art have experienced many other significant problems when attempting to plate porous aluminum castings. See, e.g., F. L. Mickelson, "Problems in Finishing Aluminum Castings", *Plating,* November, 1966, pages 1319–1322. Thus, Mickelson has recognized that the grain structure of such aluminum castings tends to permit formation of non-conductive precipitates in the grain of the casting substrate when the casting melt is cooled; such non-conductive precipitates commonly including $Mg_2Si$, $Al_3Mg_2$ and $CuAl_2$, all of which tend to cause blistering of plated areas and the presence of undesired random unplated areas. Mickelson has further pointed out that surface contaminations such, *for example,* as mold releases, imbedded iron, magnesium or sand, and thick hard oxides, can ultimately lead to blistering and/or resulting random unplated surface areas. Moreover, the porosity of aluminum castings resulting from the presence of highly soluble hydrogen in the molten aluminum (see, also, E. Player, *Symposium on Aluminum Alloy Castings,* London, The Aluminum Development Association, 1953, page 110) also tends to promote surface contamination since solutions used in chemical processing (other than rinse water) are often trapped within surface porosities and are, therefore, carried into the next process step as surface contaminants. Thus, if the aluminum melt is not properly degassed at the foundry, the casting tends to be extremely porous and leads to the presence of undesired surface contaminants in the holes at the surface of the casting. It is further to be noted that any unplated surface porosity is also a target of high pH (i.e., a pH greater than 10) solution attack, thus producing both blistering and a vulnerable area for corrosion when the plated casting is in service.

Another significant problem area recognized by Mickelson is the need to remove smut which often leads to blistering of the final deposit, apparently as a direct result of adhesion failure between the porous cast aluminum substrate and the protective coating plated thereon which is commonly either a zincate or a stannate coating. Mickelson suggests nitric-hydrofluoric acid etching to solve the smut problem; but, recognizes that the process is very difficult to control, heats us rapidly, gives off dangerous nitric oxide fumes, and tends to roughly etch the casting. A further problem area delineated by Mickelson resides in the fact that the silicon oxide on the surface of aluminum castings produces a non-wettable (hydrophobic) surface which does not accept plating deposits. Consequently, it is necessary to hydrate or partially remove such oxides by treatment with HF in the presence of water to produce a wettable (hydrophilic) surface. Silicon particle size, which is controlled by the cooling rate of the aluminum melt, is a significant factor in obtaining consistently good plating adhesion. Thus, large high surface area particles produce the largest non-wettable areas and, consequently, the greatest blistering problem—a problem which is more significant when dealing with investment castings than when dealing with quality sand castings. Yet another problem that Mickelson has recognized leads to blistering and to the production of randomly located uplated areas is the fact that microcracks in an aluminum casting tend to absorb oil during the machining process and, subsequent treatment of the workpiece with hot cleaning and/or etching solutions tends to leach the oil from the microcracks, thereby promoting blistering.

Mickelson has proposed a process for plating aluminum castings with chromium which employs a hot alkaline etching step followed by a nitric-hydrofluoric acid desmutting step—steps which he suggests might be eliminated when dealing with "castings of good surface quality" (see, Mickelson, supra, at page 1322). However, it has been found in practice that aluminum castings plated in accordance with conventional processes, such as the process described by Mickelson, are subject to blistering, flaking and separation between the plating and substrate even when the casting has good surface qualities and such etching/desmutting steps are carried out.

The prior art is replete with proposed processes for plating aluminum, aluminum alloys, other metals and/or metallic alloys and, even porous aluminum castings. Such disclosures may, *for example,* be found in: Peters et al U.S. Pat. No. 3,466,156 and Stone et al. U.S. Pat. No. 3,738,818 (processes for plating aluminum and/or aluminum alloys wherein an electroless nickel plate is deposited on a double zincate coating on the substrate); Simon U.S. Pat. No. 3,180,715 (a process for cobalt plating of 6061-T6 wrought aluminum utilizing an ALUMON®—a registered trademark of Enthone Incorporated, West Haven, Conn.—double zincate process); Colonel U.S. Pat. No. 3,281,266 (a process for electroless nickel plating over a double zincate protective coating with an intermediate 1-2 minute acid soak); Dunlop, Jr. et al. U.S. Pat. No. 3,202,529 (a process for nickel-cobalt plating of pure aluminum and aluminum alloys employing a zincate coating); Wright et al. U.S. Pat. No. 3,666,529 (a process for electroless nickel plating of 1100, 2024, 3003, 5052, 6061 and 7075 wrought aluminum); Dean U.S. Pat. No. 3,681,019 (a process for zinc plating of aluminum and/or aluminum alloys); Bernstein U.S. Pat. No. 4,115,604 (a process for plating wrought sheet aluminum); a literature review authored by Dr. D. S. Lashmore entitled "Immersion Deposit Pretreatments for Electroplating on Aluminum", *Plating & Surface Finishing,* April, 1978, pages 44-47 (a review of numerous immersion pretreatment used with aluminum substrates); Hoover et al. U.S. Pat. No. 2,407,881 (a process for depositing a zinc coating on a steel substrate); and, Jones et al. U.S. Pat. No. 3,498,823 (a process for electroless nickel and tin plating on copper substrates).

While none of the foregoing prior art references pertain to, or disclose, processes purported to be useful in plating of porous aluminum castings, the aforesaid Mickelson article, supra, does disclose the problems encountered when attempting to plate such porous aluminum castings and a proposed process for plating such castings. Similarly, Coll-Palagos U.S. Pat. No. 3,726,771 purports to disclose a process for chemically plating nickel on " . . . any type of aluminum and its alloys . . . " (Col. 3, line 34) and wherein it is stated that the aluminum can be " . . . cast, wrought, extruded . . . " (see, e.g., Col. 3, lines 33-43). The patentee goes onto describe an " . . . alternate procedure . . . " which should be used " . . . with aluminum having a high degee of silicate content . . . " (Col. 3, line 44 et seq). However, the specific processes disclosed in the Mickelson article and in the Coll-Palagos patent are known to produce poor results when attempting to plate porous aluminum castings.

SUMMARY OF THE INVENTION

It is a general aim of the present invention to provide improved processes for forming blister-free metallic plates on aluminum substrates, including porous aluminum castings, which overcome all the foregoing disadvantages characteristic of, and inherent in, conventional prior art plating processes heretofore used in attempts to plate aluminum substrates and porous aluminum castings; yet, which are economical and which minimize capital investment requirements.

In one of its principal aspects, it is an object of the invention to provide improved methods for plating aluminum substrates and porous aluminum castings, and to provide improved plated aluminum substrates and/or castings formed thereby, characterized in that: (i) the surface of the aluminum substrate is activated by rendering it uniformly conductive by removal of all non-conductive and/or non-wettable particles and films such, *for example,* as silicon oxide, alloying particles, and smut, while producing only minimal etching of the substrate; (ii) the thus activated surface of the aluminum substrate has a high adhesion protective coating applied thereto; (iii) a non-porous metallic strike or underplate is applied to the protective coating from a low pH bath to prevent alkaline solution attack of the substrate and to permit uniform plating over the irregular aluminum substrate surface—here, electroless plating processes are preferred because they can best provide a uniform plating over an irregular casting surface; and (iv), the final plating is applied from a low pH, low temperature bath so as to minimize the spontaneous formation of low adhesion immersion deposits.

It is a more detailed object of the invention to provide improved processes for plating porous aluminum castings which comprise the steps of: (i) activating the cast aluminum substrate surface by room temperature alkaline emulsion cleaning and room temperature dilute acid/fluoride salt solution deoxidation so as to minimize surface etching of the substrate; (ii) applying a zincate protective coating thereto; (iii) applying an electroless nickel strike to the protective coating; and (iv), applying an outer conductive metal plating to the cast aluminum workpiece from a low pH acid metal bath at room temperature; yet, wherein each step of the process permits of ease of chemical solution makeup, operation and control, and wherein the overall cost of the process and the process time required to plate cast porous aluminum substrates are significantly reduced.

In another of its principal aspects, it is an object of the invention to provide improved processes for plating porous aluminum castings, and improved plated castings formed thereby, characterized by their economy and high production rates; yet, wherein the plated aluminum castings produced are substantially devoid of blisters and/or flaking and are characterized by a secure adhesion bond between the cast aluminum substrate and the plating deposits.

It is an important object of the invention to provide improved processes for applying conductive metal plating deposits to the surfaces of porous aluminum castings wherein excellent adhesion is achieved between the substrate and successive deposits applied thereto on a consistent, reproducible basis irrespective of the surface quality of the porous cast aluminum substrate; and, wherein the process yield of acceptable plated castings is significantly higher than heretofore attained with conventional plating techniques—indeed, where process yields begin to approach 100%.

A further general objective of the invention is to provide an improved process for plating porous aluminum castings which avoids the need for hot caustic etching of the workpieces, thus not only reducing energy consumption but, moreover, significantly reducing surface etching of the workpiece itself; yet, wherein surface oxides, non-wettable particles, alloying particles, smut and other surface contaminants are rapidly and effectively removed from the casting so as to permit high adhesion between the cast aluminum substrate and successive plating deposits subsequently applied thereto.

In one of the more detailed aspects, it is an object of the invention to provide improved processes for applying conductive tin plating uniformly to activated porous aluminum casting surfaces and wherein the tin is plated on the cast aluminum substrate from a low pH acid bath maintained at room temperature so as to: (i) prevent plating solution attack of the substrate and thereby prevent blistering; (ii) minimize energy consumption; (iii) substantially increase plating rates over those attainable with conventional hot alkaline plating baths; and (iv), to thereby produce blister-free tin plated aluminum castings having a smooth, fine-grained plating with relatively low surface contact resistance.

As a result of obtaining the foregoing objectives, it has been found that in practice excellent results are achieved when plating porous aluminum castings in accordance with the present invention in terms of: (i) high process yield rates which are in excess of 20% higher than heretofore obtainable, even after necessary repairs to defectively plated products produced with conventional plating techniques; (ii) more rapid plating rates which, on average, require only about 30% of the total process time heretofore required by conventional hot alkaline plating techniques; (iii) low requisite costs for establishing and maintaining chemical plating solutions—material costs which are, on average, only about 68% of those incurred with conventional plating techniques; (iv) substantially lower energy consumption and the attendant costs associated therewith; (v) reduced capital investment; and (vi), more effective use of human capital resources as a direct result of employing chemical solutions which are substantially maintenance free and permit of ease of makeup, operation and control. And, notwithstanding all of the foregoing cost saving and time saving advantages, the plated aluminum castings produced in accordance with the invention are, when compared to prior art plated aluminum castings and, irrespective of the quality of the cast aluminum microstructure as produced by the foundry, more corrosion resistant, improved in terms of plating integrity, devoid of blisters and/or plating separations at the interfaces between the substrate and superimposed plating deposits and, additionally, such castings, when plated in accordance with the invention, possess improved characteristics in terms of conductivity and surface contact resistance.

In the course of the development work conducted leading to the present invention, many processes were tested in an effort to consistently obtain a blister-free (tin) plating on porous aluminum substrates; *especially,* on aluminum castings. The adhesion requirement was that the plating must withstand baking at 200°-225° F. for 1 hour (a thermal adhesion test) without blistering. At the beginning of the test program, using a hot, pH tin plating bath, the below-listed process steps were used, both singly and in combination, and in virtually every sensible permutation. The result was blistered (tin) plating upon removal of the work from the plating bath, or blistering of the plating after baking. More specifically, the following process steps were examined: (i) vapor degreasing; (ii) hot, non-etch soak cleaners; (iii) room temperature, non-etch emulsion cleaners; (iv) concentrated nitric-hydrofluoric acid and chromic-nitric-hydrofluoric acid activators; (v) moderately dilute zincates (less than 300 g./l. total salts; high pH) which were employed in single, double and multiple zincating processes; (vi), hot, high pH cyanide copper strikes; (vii) high pH caustic etches; (viii) high pH caustic etches containing chelating agents (to improve smut removal); (ix) polyester resin impregnation of the porous substrates to decrease or eliminate surface porosity (this apparently decreased the occurrence of blistered plating severity, but did not eliminate it); and (x), high pH immersion tin plating instead of immersion zinc plating (zincating); all with unacceptable results.

Later, ALUMON ®D, a dilute zincate (less than 180 g./l. total salts) with chelating reagents, was utilized in place of moderately dilute zincates to reduce surface contamination in the substrate porosities. ALUMON ®D was tested with the aforementioned process steps and also with dilute nitric-hydrofluoric acid activators. No blister-free tin plating could be consistently obtained on porous aluminum castings.

Thereafter, dilute nitric-sulfuric activations containing ammoniumbifluoride and dissolved aluminum, and high pH caustic etches, both with and without chelating agents, were used in conjunction with a cyanide copper strike prior to hot, high pH tin plating. Again, no blister-free tin plating could be consistently obtained on porous aluminum castings.

It was observed that high pH solutions attacked the aluminum alloy substrates, especially when surface porosity was present. Therefore, a thick underplate of copper, applied from a low pH, acid bath was deposited over a cyanide copper strike. The combination of these two copper layers served as a composite barrier layer to prevent high pH, hot tin solutions from attacking the porosities in the casting surface. The cyanide copper strike was used beneath the thick coating of acid copper because it had greater throwing power to electroplate the porous aluminum surface, but could not produce a sound deposit over about 0.0001" thick. Furthermore, extended exposure of the aluminum in hot, high pH solutions resulted in blistering of the resultant copper deposit or blistering of the subsequent tin deposit. To build up a sufficient thickness of copper to function as a barrier layer, plating from an acid copper bath was necessary after the cyanide copper strike was applied. Because of the lengthly time required to plate the copper barrier layer, and the complications of using two different electroplating baths, a less porous deposit applied from one bath was sought so that a thinner barrier layer could be utilized. Electroless nickel plate was found to be a superior barrier layer than was electrodeposited copper.

Recognizing that high pH, high temperature solutions attacked aluminum and aluminum alloy substrates, *especially* when surface porosities are present, a low pH, low temperature acid tin bath was tested. It was found that only a very thin barrier layer of electroless nickel was required when using: (i) a room temperature, non-etch emulsion cleaner; (ii) a dilute, room temperature, low pH nitric-sulfuric acid activator containing a high degree of ammoniumbifloride—i.e., on the order of 12 oz./gal., or more, ammoniumbiflouride—and dissolved aluminum; (iii) a dilute, room temperature zincate bath, preferably containing chelating agents to restrict the chemical activity of the zinc to complex dissolved by-products of the zincating reaction; and (iv), an outermost layer of plating, if other than electroless nickel (tin, etc.), applied in a low pH (acid), low temperature plating bath.

It has been found that the processes of the present invention economically produce electroless nickel, tin or other plated coatings on porous aluminum or aluminum alloys having smooth surfaces or a high degree of surface porosity as commonly found in castings. The blister-free yield of plated products is much higher than heretofore achievable with prior art processing techniques of the types previously described. This reflects typically higher plate adhesion, which may exceed 9,200 pounds per square inch tensile strength. Hence, a superior plated aluminum or aluminum alloy product is obtained regardless of the surface condition of the substrate.

DESCRIPTION OF THE DRAWINGS

These and other objects and advantages of the present invention will become more readily apparent upon reading the following detailed description and upon reference to the attached drawings, in which:

FIG. 13 is a microphotograph (500X magnification) illustrating the secure bonding of plating deposits to alloying constituents and the cast substrate which results when utilizing plating processes embodying the features of the present invention;

FIG. 14 is a highly magnified (1000X) microphotograph here illustrating the excellent adhesion properties and secure bonding that results when applying electroless nickel plating to a porous aluminum casting having magnesium particles located therein when such casting surface is activated and the electroless nickel plated thereon in accordance with the present invention;

FIG. 15 is a microphotographic view (1000X) similar to FIG. 14, here depicting the superior electroless nickel throwing power which occurs in the practice of the present invention and the secure bonding of plating deposits to silicon particles within the substrate porosities;

FIG. 19 is a microphotograph at ten-power magnification here illustrating how the fine-grained, smooth, bright tin finish on a porous aluminum casting tends to accentuate small surface imperfections within the casting itself with such imperfections seemingly appearing as relatively tiny blisters;

FIG. 20 is a highly magnified (500X) microphotograph of the defect shown in FIG. 19, here demonstrating that such defect is not a blister but, rather, is a barely visible pit having a smooth hemispherical bottom resulting from surface alloying particles removed from the casting during the deoxidizing step;

FIG. 23 is a microphotograph (200X) illustrating the microstructure of quality grade aluminum castings which are platable in accordance with the present invention; and, FIG. 24 is a microphotographic view (200X) similar to that shown in FIG. 23, but here illustrating particularly the microstructure of inferior grade aluminum castings which are also platable in accordance with the present invention.

Figure 1:
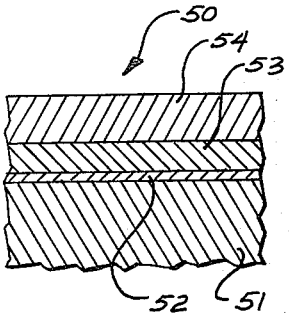
FIG. 1 is a diagrammatic cross-sectional view illustrating in a highly idealized form an aluminum substrate—e.g., a cast porous aluminum substrate—and the successive thin-film plating deposits applied thereto in accordance with the present invention.

While the invention is susceptible of various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents and alternatives falling within the spirit and scope of the invention as expressed in the appended claims.

DETAILED DESCRIPTION

Referring first to FIG. 1, there has been diagrammatically illustrated in vertical cross section a typical metallic plated aluminum piece part—e.g., a porous aluminum casting—generally indicated at 50. As here shown, the plated piece part 50 includes an aluminum substrate 51 upon which has been deposited a thin protective metal coating 52 with the interface therebetween constituting the most critical area in the plating process where excellent uniform adhesion is required; but, where conventional plating techniques heretofore employed have failed to consistently and reproducibly meet the necessary adhesion characteristics required to effect a secure uniform bond. Indeed, such conventional prior art plating techniques have generally been plagued with problems, particularly in obtaining proper activation of the surface of the aluminum substrate 51 to be plated, resulting in either or both of (i) attainment of poor adhesion characteristics between the protective coating 52 and the substrate 51 leading to blistering and/or flaking of the final deposit and/or (ii), the formation of randomly located areas on the substrate wherein no protective coating is present.

Various types of protective coatings 52 have conventionally been used including, merely by way of example: a zinc immersion process—commonly referred to in the art as a "zincate" process—as disclosed in Hewitson U.S. Pat. No. 1,627,900; the "double zincate" process as illustrated in Korpiun U.S. Pat. No. 2,142,564 (see, also, the aforesaid Peters et al. and Stone et al. U.S. Pat. Nos. 3,466,156 and 3,738,818); various modifications of the zincate and double zincate processes as disclosed in the aforesaid Mickelson article and in Mickelson et al. U.S. Pat. No. 3,235,404 (a zincate process employing a sodium gluconate complexing agent to assist in removal of aluminum salts), the aforesaid Simon U.S. Pat. No. 3,180,715 (an ALUMON® double zincate process) and, the aforesaid Colonel U.S. Pat. No. 3,281,266 (a double zincate process with an intermediate acid soak); immersion treatments utilizing solutions containing metal fluorides (Perner U.S. Pat. No. 2,297,241); the "Bondal process" using, inter alia, various metal sulfates (Br. Pat. No. 1,007,252); a stannate process (see, e.g., Jongkind et al U.S. Pat. No. 3,274,021); and numerous other processes (see, e.g., Zelley U.S. Pat. Nos. 2,650,886 and 2,676,916, Kampert U.S. Pat. No. 3,989,606 and, Baig U.S. Pat. No. 3,417,005). However, in the present invention it is preferred that a modified double zincate process be employed and, consequently, the protective coating 52 here shown comprises a relatively thin layer of zinc. Zinc is chosen because it readily displaces aluminum atoms on the substrate surface and has an electrode potential similar to that of aluminum, thus resulting in a small galvanic couple and minimal propagation of corrosion via galvanic coupling.

Following deposition of the protective coating 52, it is a conventional practice to apply an underplate 53 which has conventionally comprised a cyanide copper strike, a relatively thin copper underplate, or an electroless nickel strike or plate, all of which are intended to prevent solution attack of the cast aluminum substrate by agressive solutions of the type commonly employed when immersing the product in the final plating bath such, *for example,* as a hot, high pH (a pH=13), alkaline tin bath, at which time the workpiece 50 has a final outer plating deposit 54 applied thereto, such deposit 54 generally comprising an electrically conductive metallic plating.

Figure 2:
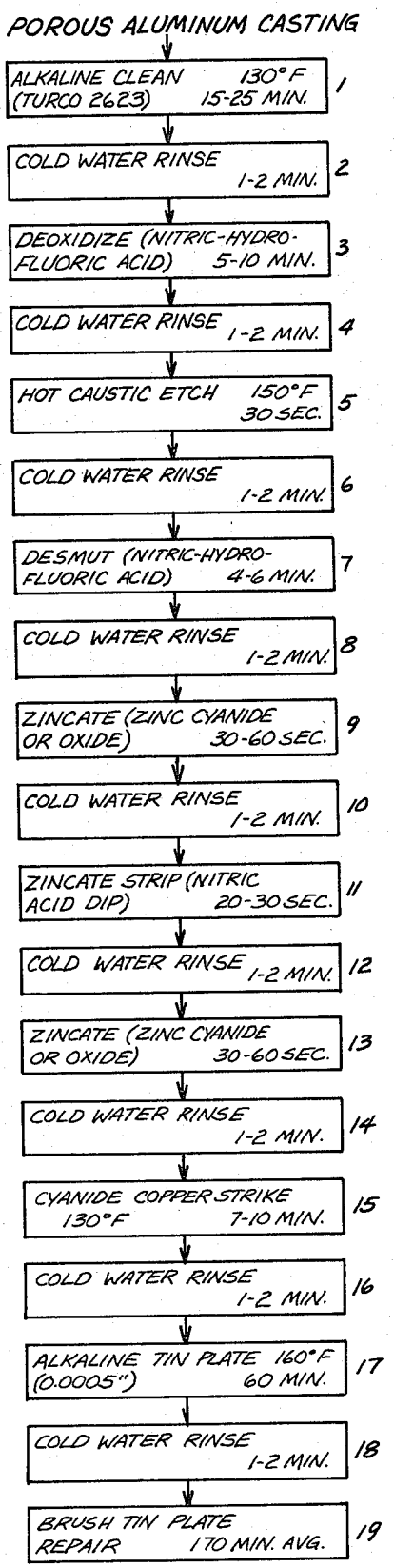
FIG. 2 PRIOR ART
FIG. 2 is a block-and-line diagram depicting the major process steps commonly involved in a typical conventional plating process of the type heretofore commonly used in the prior art when attempting to apply a tin plate to porous aluminum castings.

Turning to FIG. 2, there has been diagrammatically illustrated in block-and-line form a conventional process for tin plating aluminum substrates in an effort to form a plated piece part such as the plated aluminum piece part 50 shown in FIG. 1. The conventional process here depicted is one that has been employed from time to time by the assignee of the present invention to plate aluminum, aluminum alloys, and/or aluminum castings and, is somewhat similar to that described at page 1322 in the aforesaid Mickelson article, supra (*Plating,* November, 1966, pages 1319–1322), except that Mickelson has described a process for applying a chromium electroplated outer layer over a nickel plating on a porous aluminum casting.

In general, the conventional process as illustrated in FIG. 2 contemplates an eight step process for activating the surface of the aluminum substrate to be plated—although those skilled in the art will appreciate that commonly the workpieces to be plated will contain excessive surface contaminations in the form of oil, grease or the like of sufficient magnitude as to require a preliminary vapor degreasing or solvent degreasing pre-cleaning step. However, Step 1 here illustrated is one common to virtually all known processes for plating aluminum piece parts and, involves an alkaline cleaning procedure in which the assignee of the present invention has, *for example,* used a commercially available alkaline cleaner (TURCO 2623) supplied by Turco Products, Inc., Livermore, Calif., in a heated bath maintained at 130° F. for periods ranging from 15–25 minutes, followed by a cold water rinse of 1–2 minutes duration (Step 2). Following the cold water rinse, the cleaned workpiece is immersed in a nitric-hydrofluoric acid bath (75% nitric acid, 40°–42° Be', O-N-350, and 25% hydrofluoric acid—70% Technical Grade, O-H-795) for a period ranging from 5–10 minutes for the purpose of dissolving silicon oxides and alloying particles (Step 3). Experience has demonstrated that such a process, while effective in removal of surface oxides and alloying particles, serves to produce a rough etched surface on the substrate 51 (*for example,* etch rates of from 1.8 to 4.8 mil/surface/hr. are common) and, additionally, is only marginally effective with regard to smut removal. Again, the deoxidized substrate is subjected to a cold water rinse (Step 4). Cf., Steps 3 and 4 in Mickelson, supra at page 1322. Because of the lack of effectiveness of the deoxidizing step (Step 3) in removal of smut and other contaminants, it has generally been necessary to further provide for a hot caustic etch (Step 5) and a nitric-hydrofluoric acid desmutting immersion process (Step 7), each followed by a cold water rinse (Steps 6 and 8). Cf., Mickelson, supra at page 1322, Steps 5–8.

The aluminum substrate 51 (FIG. 1) was, following the conventional surface activating steps described above (Steps 1–8), then subjected to a conventional double zincate procedure (Steps 9–14, FIG. 2) wherein the workpiece was immersed in a zinc plating solution (Step 9)—a solution that may, *for example,* comprise either a zinc cyanide solution or a zinc oxide solution—rinsed (Step 10), the thin zinc coating stripped therefrom by dipping in nitric acid for 20–30 seconds (Step 11), rinsed (Step 12), and again immersed in the zincate solution (Step 13) to apply a thin protective zinc coating thereto. Following application of the thin zinc deposit 52 (FIG. 1) on the activated surface of the aluminum substrate 51 during the second immersion in the zinc plating solution (Step 13), the workpiece was again thoroughly rinsed (Step 14) and then immersed in a cyanide copper strike solution maintained at 130° F. for a period of from 7–10 minutes (Step 15) so as to form a thin, non-porous, copper strike 53 (FIG. 1) on the workpiece intended to prevent solution attack of the aluminum substrate 51 by the final plating bath.

Thereafter, the workpiece was again thoroughly rinsed (Step 16), and then immersed in the final plating solution which here conventionally comprised a high pH (a pH=13), alkaline tin bath maintained at 160° F. for sixty minutes to form a conductive outer tin plate 54 (FIG. 1) 0.0005" thick (Step 17). The thus plated workpieces were then rinsed (Step 18) and inspected. Because severe problems of blistering and flaking were generally encountered, it was found necessary to routinely repair defectively plated substrates (Step 19), necessitating considerable expense and time.

Figure 4:
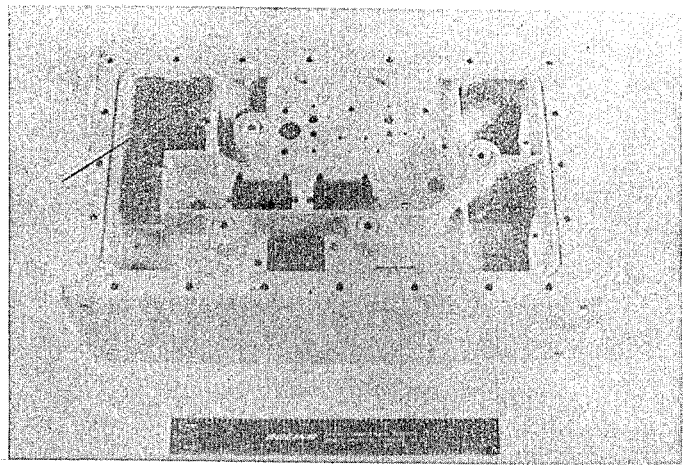
FIG. 4 PRIOR ART
FIG. 4 is a photographic view of a typical cast aluminum piece part—here, a filter casting—having tin plating applied thereto by a conventional plating process such as the process diagrammatically illustrated in FIG. 2, here illustrating the uniformly blistered plating that results from such process.
Figure 5:
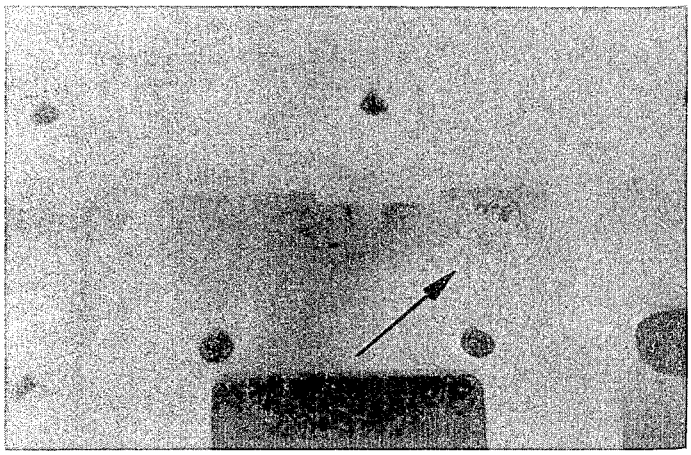
FIG. 5 PRIOR ART
FIG. 5 is an enlarged close-up view of a portion of the piece part shown in FIG. 4, here depicting the severity of the blistering problem that results from conventional plating techniques.
Figure 6:
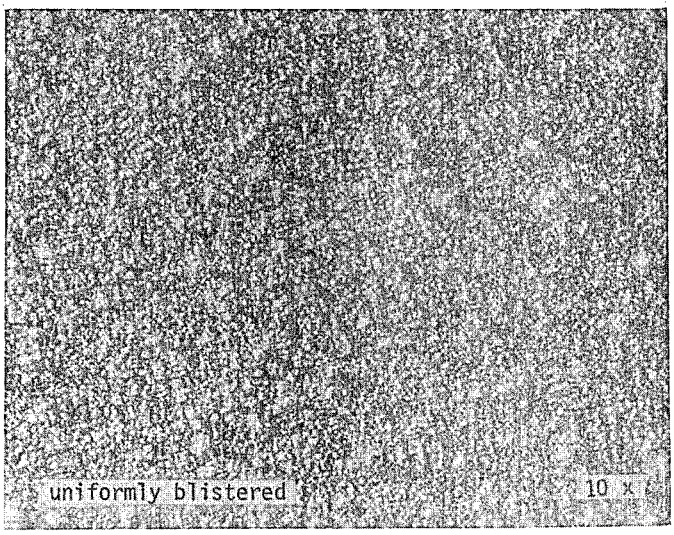
FIG. 6 PRIOR ART
FIG. 6 is a photograph under ten-power (10X) magnification, here depicting the uniform blistered plating that is produced on machined cast aluminum surfaces by conventional plating techniques.
Figure 7:
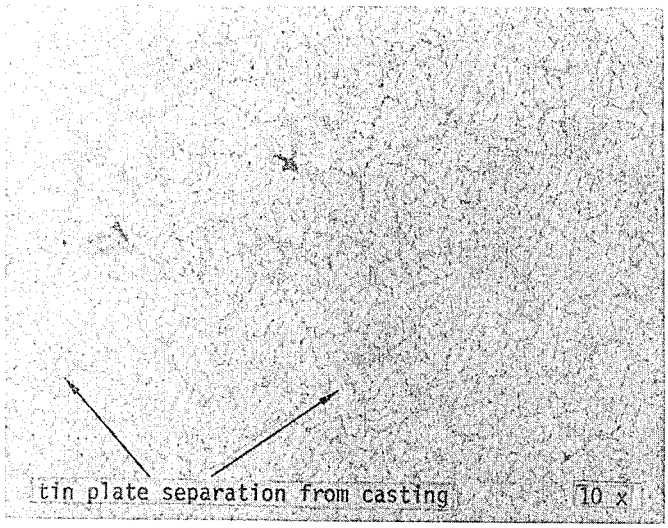
FIG. 7 PRIOR ART
FIG. 7 is a photographic view similar to FIG. 6, also under ten-power magnification, depicting the separation and flaking of tin plate from a cast aluminum substrate that commonly results from underetched casting surfaces when attempting to minimize the blistering problems shown in FIG. 6.

Referring now to FIGS. 4–6 there has been photographically illustrated a typical finished cast aluminum product plated in accordance with the conventional plating process of FIG. 2. As here depicted, it will be observed that a severe, generally uniform, blistering problem was encountered as a direct result of surface porosity (an inherent characteristic of aluminum castings), the presence of non-platable alloying particles, and excessive etching of the cast aluminum substrate during the surface activating steps (Steps 1–8 in FIG. 2; esp., Steps 3, 5 and 7). When attempts were made to minimize the excessive etching effect by reducing the immersion periods in Steps 3, 5 and 7, the result was ineffective activation of the substrate surface resulting from incomplete removal of non-wettable surface oxides and non-conductive particles, thus resulting in peeling and flaking of the deposit from the machined surface of the casting, as best illustrated in FIG. 7.

Figure 8:
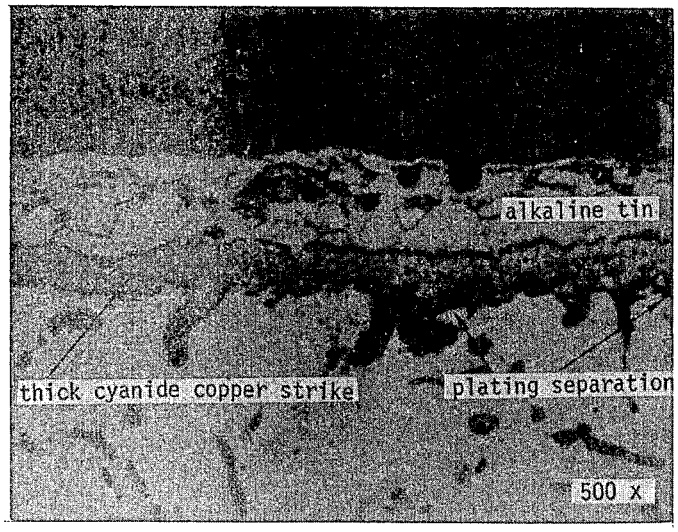
FIG. 8 PRIOR ART
FIG. 8 is a highly magnified (500X) microphotograph of a plated cast aluminum substrate wherein tin plating is deposited on a cyanide copper strike in accordance with conventional plating techniques, and here illustrating the separation that commonly occurs between the substrate and the plating deposits thereon.
Figure 9:
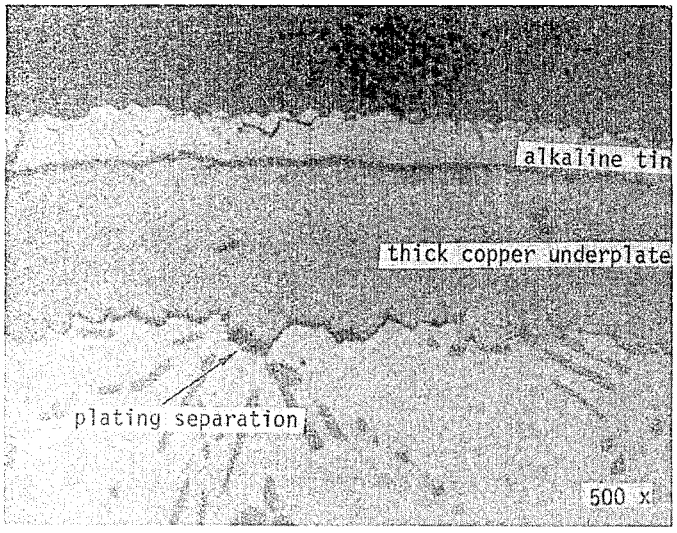
FIG. 9 PRIOR ART
FIG. 9 is a highly magnified (500X) microphotograph similar to FIG. 8, again illustrating the problem of plating separation that occurs with conventional plating techniques even when employing relatively thick copper underplates in an attempt to prevent solution attack of the substrate by high pH hot alkaline tin baths.
Figure 10:
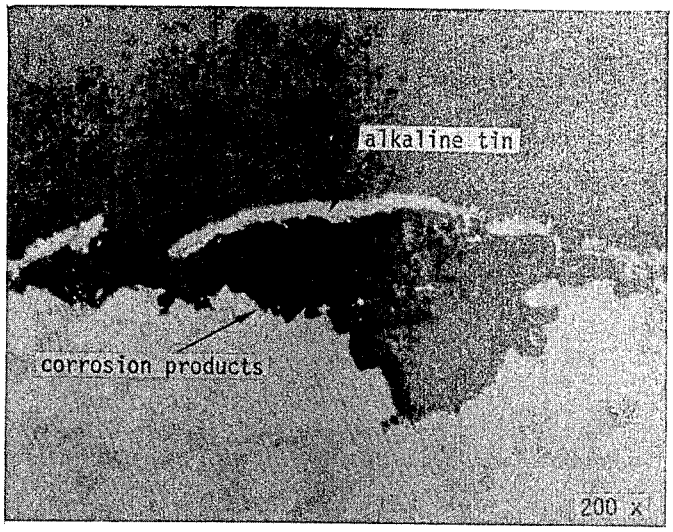
FIG. 10 PRIOR ART
FIG. 10 is a microphotograph (200X) illustrating blistering resulting from corrosion product accummulations caused by hot alkaline tin plating solution attack of the substrate when employing a conventional plating process of the type shown diagrammatically in FIG. 2.
Figure 11:
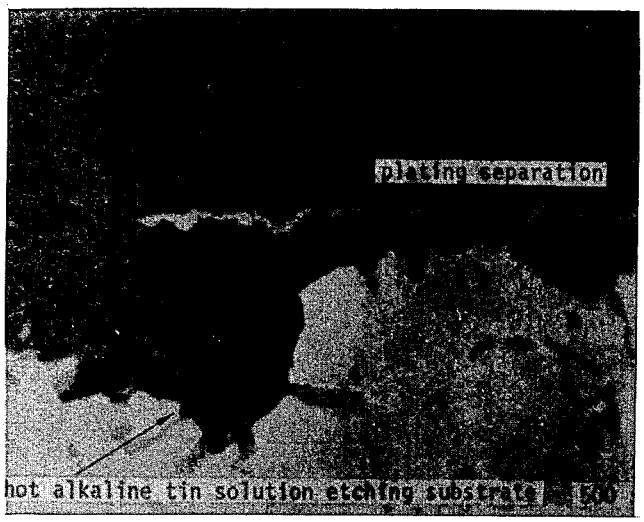
FIG. 11 PRIOR ART
FIG. 11 is a microphotographic view (500X) depicting the resultant severe etching of the substrate surface and consequent separation of the plating therefrom caused by solution attack from conventional hot alkaline tin plating solutions.

The seriousness of the blistering problems encountered is best depicted by references to FIGS. 8–11 conjointly. Thus, as illustrated in FIG. 8, it will be observed that the cyanide copper strike is characterized by excessive areas of separation from the zinc protective coating and, because of insufficient throwing power, the cyanide copper strike failed to fill the surface porosities in the cast aluminum substrate. Such areas of separation result directly in blistering of the final plated coating. In an effort to prevent alkaline solution attack of the cast aluminum substrate, particularly in the regions of separation, a relatively thick acid copper underplate was applied over the zinc and cyanide copper strike layers in an attempt to provide a non-porous barrier (FIG. 9). Although it was found that copper underplates on the order of 0.002" thick and greater did eliminate the immediate formation of blisters, nevertheless relatively large blisters (on the order of up to 0.25" D) would appear after four days of salt spray exposure. This is believed to have been in large part attributable to the fact that poor adhesion existed at the zinc/cyanide copper strike interface as evidenced by the plating separation visible in FIG. 9. Moreover, it was further noted that significant blistering generally occurred during the hot alkaline tin bath immersion step (Step 17, FIG. 2); presumably as a direct result of solution attack of the cast aluminum substrate by the hot, highly alkaline (pH=13), solution, particularly in the area of plating separation at the zinc/cyanide copper interface. Thus, as is clearly evident upon inspection of FIGS. 10 and 11, severe accummulations of corrosion products (FIG. 10) and excessive etching of the casting substrate (FIG. 11) were discovered following a 60 minute immersion in the hot alkaline tin plate solution—not a surprising result since the conditions encountered are essentially the same as those that would be encountered with most aluminum chemical milling solutions.

Figure 12:
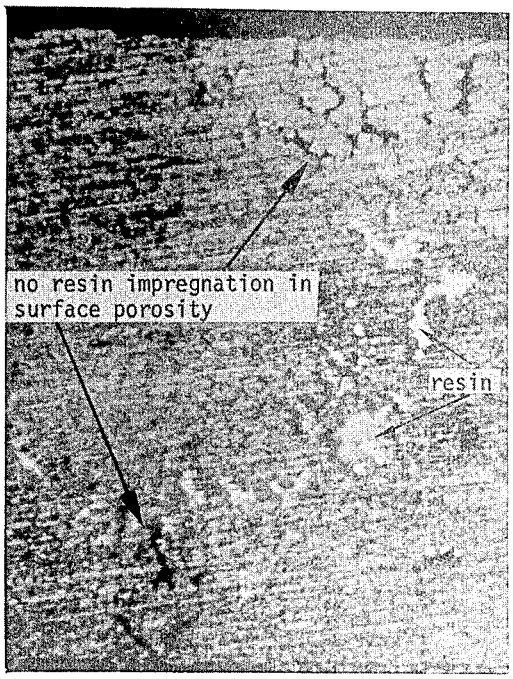
FIG. 12 PRIOR ART
FIG. 12 is a photographic view of a porous cast aluminum substrate wherein an attempt has been made to reduce the effects of surface porosity by resin impregnation, here illustrating particularly the effect of subsequent rinse steps which serve to remove the resin from surface porosities.

Of course, many of the problems discussed above are, in large part, attributable to the surface porosity of the cast aluminum substrate. Efforts to minimize this problem by resin impregnation proved to be unsuccessful, as indicated in FIG. 12. Thus, the resin wash step required to remove resin from the casting surface served also to remove the resin from the casting porosities as well.

Numerous control problems were encountered in the practice of the conventional tin plating technique shown in FIG. 2. *For example,* Steps 1, 5, 15 and 17 required maintenance of elevated temperature levels ranging from 130° F. (Steps 1 and 15), to 150° F. (Step 5), to 160° F. for sixty minutes (Step 17), thus requiring excessive energy consumption. Both the zinc cyanide and zinc oxide plating solutions usable in Steps 9 and 13 require complex solution makeup procedures and, once made up, such solutions were extremely difficult to control. Similarly the cyanide copper strike bath used in Step 15, although relatively easy in terms of solution makeup, was exceedingly difficult to control since, when attempting to plate tin from a hot alkaline tin bath on a cyanide copper strike, it was found essential that the pH of the cyanide copper strike solution be maintained below 10.3 and the free cyanide below 0.25 oz./gal.—otherwise blistering of the tin occurred upon baking; while the alkaline tin bath solution (Step 17) required continuous maintenance and addition of sodium stannate ($Sn^{+4}$) in order to maintain the bath in condition for use.

And finally, even after brush tin plate repair (Step 19)—a time consuming, costly procedure—process yield was limited to 80% or less, thus requiring complete stripping of defectively plated products—i.e., stripping of at least 20% of the raw materials input to the process. Even those plated products which met acceptable minimum standards tended to have a dull grainy appearance and relatively high surface contact resistance (63 mhos/in.$^2$). Moreover, the process as a whole was relatively slow, requiring on the order of from 272 to 302 minutes and, further requiring the use of eleven tanks, four of which had to be heated.

PROCESS EMBODYING FEATURES OF THE PRESENT INVENTION AND PLATED ALUMINUM PRODUCTS PRODUCED THEREBY

In accordance with one of the important aspects of the present invention, provision is made for: (i) improving activation of the surfaces of the aluminum substrate to be plated so as to produce a uniform conductive surface by removal of essentially all non-conductive and/or non-wettable particles and films therefrom with minimal substrate etching; (ii) applying a high-adhesion protective coating to the thus activated surface to be plated; (iii) applying a non-porous strike or underplate over the high-adhesion protective coating to prevent aggressive solution attack of the substrate during the final plating step; and (iv), applying the final plate to the workpiece from a low temperature low pH (pH=1) acid bath so as to minimize formation of low-adhesion immersion deposits. It has been found in practice that plating processes carried out in accordance with the foregoing aspects of the invention are characterized by low operating costs, reduced capital equipment requirements, reduced energy consumption, ease of process solution makeup and control, greatly improved rates of plating, and reliable, highly reproducible, high process yields. Indeed not only is the process time reduced to approximately 30% of conventional hot alkaline plating process times, but, moreover, product yields have been increased from maximum yields of 80% (a yield achievable only after repair of defectively plated parts) to yields approaching 100% with product quality significantly improved in terms of consistently reproducible, high-adhesion interface bonds and consequent blister-free plating even when operating with porous aluminum castings having inferior low grade microstructures.

A. SURFACE ACTIVATION IN ACCORDANCE WITH THE PRESENT INVENTION

Figure 3:
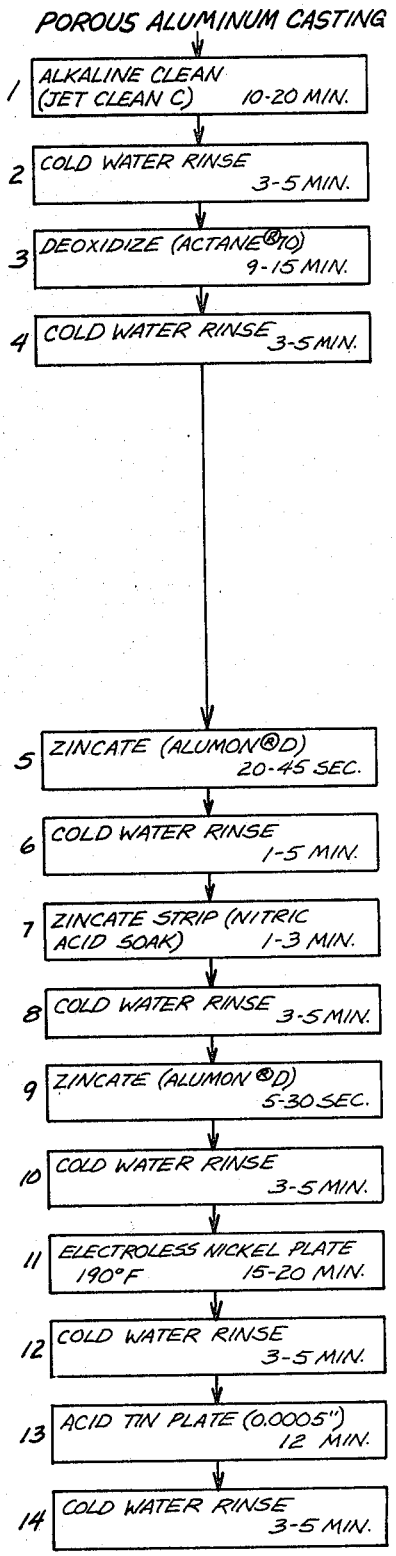
FIG. 3 is a block-and-line diagram similar to FIG. 2, but here illustrating the major process steps employed in a tin plating process for porous aluminum castings in accordance with the present invention.

In keeping with the aforementioned overall objectives of the present invention, provision is made for effectively and rapidly cleaning the surface of the aluminum substrates to be plated without requiring maintenance of high temperature cleaning solutions and in a relatively simple, easily controlled and operated, four step activation process. To accomplish this, it is preferred to use an emulsion cleaner, preferably comprising an alkaline cleaner, which can be utilized at room temperature. It has been found that excellent results can be obtained with an alkaline cleaner commercially available from Turco Products, Inc. of Livermore, Calif. and known as "Jet Clean C". Thus, as shown in FIG. 3, Step 1 of the process of the present invention involves an emulsion cleaning step utilizing an alkaline cleaner at room temperature—as contrasted with Step 1 in the prior art process shown in FIG. 2 wherein the alkaline cleaner required maintenance at temperature levels on the order of 130° F. Following emulsion cleaning (Step 1), the aluminum substrate is thoroughly rinsed in cold water for a period of from 3–5 minutes (Step 2) prior to deoxidation (Step 3).

In order to activate the surface of the aluminum substrate to be plated and to effectively remove non-wettable silicon oxides, non-conductive alloying particles, smut and other surface contaminants without excessively etching the aluminum substrate, the piece part is immersed (Step 2) for a period ranging from 9–15 minutes in a bath containing 50 volume percent nitric acid, 40° to 42° Be', O-N-350, 25 volume percent sulfuric acid, 66° Be', O-S-809, 25 volume percent water, and one pound per gallon of an acidic, fluoride-containing salt—preferably a material containing a high percentage of ammoniumbifluoride such, *for example,* as a material containing on the order of 98%, or more, ammoniumbifluoride. It has been found that particularly excellent results are obtained when using a fluoride-containing compound commercially available from Enthone Incorporated, West Haven, Conn., known as ACTANE®70 (ACTANE is a registered trademark of Enthone Incorporated) since ACTANE®70 is greater than 98% ammoniumbifluoride—indeed, such product appears to comprise at least 99% ammoniumbifluoride. Such a solution permits of ease of makeup, operation and control, and is usable at room temperature with suitable exhaust ventilation. Experimentation with workpieces subjected to immersion in this deoxidizing solution has revealed that virtually all surface contaminants including smut and non-conductive alloying particles are effectively removed from the cast aluminum substrate; yet, the substrate is not roughly etched but, rather, exhibits a smooth etched surface. Other acceptable materials include: (i)≅99 parts ammoniumbifluoride ($NH_4F_2$) plus≅1 part aluminum sulfate [$Al_2(SO_4)_3.8H_2O$]; (ii)≅99 parts $NH_4F_2$ plus≅1 part aluminum powder dissolved in the activator bath; (iii)≅99 parts $NH_4F_2$ added to a nitric-sulfuric acid solution wherein≅1 part aluminum is dissolved per ≅99 parts $NH_4F_2$—e.g., by immersion of a bare aluminum panel in the acid solution—and (iv), ≅100% $NH_4F_2$.

Moreover, etch rates are considerably reduced from those experienced with the aggressive solutions used in Steps 3, 5 and 7 of the conventional plating process hereinabove described in connection with FIG. 2, averaging only 0.9 mil/surface/hr. on A357 cast aluminum alloy as compared to from 1.8 to 4.8 mil/surface/hr. with conventional deoxidizing solutions. Costs of the deoxidizing solution used in Step 3 (FIG. 3) are only about 75% of the per gallon cost for conventional deoxidizing solutions of the types used in Steps 3 and 7 of the prior art plating process depicted in FIG. 2. Moreover, it has been found that the thus activated surface of the cast aluminum workpiece is, after a suitable cold water rinse (Step 4), in considerably better condition to accept subsequent metal deposits with excellent adhesion characteristics than was experienced with the prior art technique following Step 8 (FIG. 2)—this despite the fact that no hot caustic etch is required and no nitric-hydrofluoric acid desmut step is required, thereby resulting in further savings in material costs, energy consumption, and capital investment. It is believed that the optimum etch characteristics achieved are attributable to the presence of the inorganic ions of the fluoride salt which serve to suppress formation of HF that is believed to cause rough etching and intergranular attack; while, at the same time, sufficient $F^-$ is supplied to dissolve smut, heavy oxides, and surface silicon.

B. APPLICATION OF PROTECTIVE ZINC COATING—MODIFIED DOUBLE ZINCATE PROCESS

In carrying out the present invention, various types of procedures were tested in an effort to establish a process for applying thin protective coatings uniformly to porous aluminum castings with uniformly high adhesion characteristics and, on a consistently reproducible basis. More specifically, the double zincate process used in Steps 9–13 of the conventional plating process (FIG. 2) was, as previously indicated, found to be unsatisfactory for a number of reasons including the complexities involved in solution makeup and control. Moreover, the zinc plating solution—both the cyanide zinc and the zinc oxide solutions—were found to have relatively high zinc concentrations on the order of 6 oz./gal. and, as a result, zinc deposition rates appeared to be relatively high with attendant undesirably low zinc adhesion characteristics. Further, it was found that with relatively fresh, uncontaminated solutions it was virtually impossible to obtain satisfactory adhesion between the zinc protective coating and the cyanide copper strike; yet, when trace metallic elements including lead, cadmium, aluminum and iron were present in solution, acceptable adhesion characteristics could be generated. Finally, it was found that the concentrated zinc plating solutions of the prior art tended to produce smut on the casting which served to inhibit plating adhesion. Similarly, sodium stannate processes tested proved unsatisfactory and resulted in extremely poor adhesion characteristics when attempting to tin plate aluminum castings.

However, excellent results were achieved when utilizing a dilute zincate bath having a relatively low zinc concentration on the order of 1.1 oz./gal. *For example,* a dilute zincate bath comprising water and 20 gallons of ALUMON ®D concentrate (or 90 lbs. of ALUMON ®D powder) per 100 gallons of total tank volume has been found to have relatively low zinc concentrations (1.1 oz./gal.) and, therefore, operated at low zinc deposition rates with improved adhesion characteristics. ALUMON ®D has been described—see, e.g., Col. 12, 11. 50–71 in U.S. Pat. No. 3,216,835-Saubestre—as a zincate formulation containing the following constitutents in the amounts indicated (based on 60 to 180 g./l. of total salts):

(a) An alkali metal hydroxide, preferably sodium hydroxide, about 60 to 85 parts by weight;

(b) A zinc salt (such as zinc oxide, zinc sulfate, etc.) about 5.5 to 12 parts by weight based on the zinc content;

(c) Weight ratio of hydroxide-to-zinc: $OH^-/Zn$ (as metal): about 2.1 to 7.9 (expressed as NaOH/ZnO:4-15); and, (d) A chelating reagent in an amount from about 5 to 20 parts by weight comprising the combination of (1) from about 5 to 95 percent of at least one water soluble chelating agent having a log $k_1$ zinc stability constant of about 4.5 to 18 and (2) from about 95 to 5 percent of at least one water soluble chelating agent having a log $k_1$ zinc stability constant of about 1.5 to 4. Optionally, anionic wetting agents, up to about 2 parts by weight, may be present to lower the surface tension of the zincate.

It has further been discovered that high adhesion characteristics are achievable with both "clean" dilute zincate solutions as well as with "dirty" solutions—i.e., solutions containing other trace metal contaminants. The dilute zincate solutions tend to exhibit improved risability from porous workpiece surfaces and, the presence of chelating reagents, 5 to 20 parts by weight of total salts, serves to effectively remove smut accummulations.

Thus, referring to FIG. 3, it will be noted that in the practice of the present invention, the double zincate process employed involves immersion of the substrate in a dilute zincate bath—*for example,* an ALUMON ®D zincate bath—for a period of 20–40 seconds (Step 5) followed by a thorough cold water rinse (Step 6), a zinc stripping operation in nitric acid (Step 7), a further cold water rinse (Step 8), and a second zincate immersion and subsequent rinse (Steps 9 and 10). As contrasted with the zinc stripping step (Step 11, FIG. 2) in the conventional plating process wherein the workpiece was dipped in a nitric acid bath for 20–30 seconds—10 seconds generally being sufficient to strip the zinc from the substrate—it has been found preferable to soak the work piece in nitric acid for from one to three minutes (Step 7, FIG. 3),, a procedure which serves to produce a thin uniform oxide coating on the substrate that serves to further reduce zinc deposition rates and to thereby provide better zincate adhesion. Consistent with the objective of economy, it has been determined that the material cost of the modified double zincate process described above with respect to Steps 5 and 10 (FIG. 3) is on the order of only 60% of the material cost for the conventional process described in connection with Steps 9–14 (FIG. 2).

Based on the current use of the invention process in production, it has been observed that certain heat treated wrought aluminum alloys require a longer zincating time (Steps 5 and 9, FIG. 3), up to 3 minutes, to immersion deposit a zinc coating on the workpiece. The zincate immersion time can be shortened to the times indicated above by using a warm water rinse (110°–130°

F. for 3 to 5 minutes) after a 15 to 30 second cold water rinse prior to zincating. With reference to FIG. 3, the warm water rinses would come after the cold water rinses, Steps 4 and 8. This technique, however, is used only for certain heat treated alloys which do not receive a visable zinc coating in the specified zincate immersion times.

It should be noted that warm water rinses above 130° F. cause the residual zincate solution to attack porous aluminum workpiece surfaces and severely reduce zincate adhesion. Hence, higher temperatures should be avoided.

Another process modification used in production has been to warm water rinse (110°-130° F. for 3 to 5 minutes) all workpieces after a 15 to 30 second cold water rinse, prior to electroless nickel plate (Step 11). This serves to (i) insure thorough rinsing of the zincate solution from the workpieces to prevent contamination of the electroless nickel bath and (ii) to pre-heat the workpieces so that the plating reaction may occur more rapidly upon immersion into the electroless plating bath. For large or thick-walled workpieces which were cold water rinsed, the time duration in which plating begins after immersion may be excessive such that the electroless plate adhesion to the workpieces is reduced.

C. ELECTROLESS NICKEL STRIKE APPLICATION

As previously indicated, in the conventional plating process of FIG. 2, considerable problems were found to exist when attempting to apply either a cyanide copper strike (Step 15, FIG. 2) or a relatively thick copper underplate to the zincate protective coating on a porous aluminum casting as a result of (i) poor adhesion at the zinc/cyanide copper strike interface, (ii) poor throwing power into surface porosities in the porous aluminum casting, and (iii) difficulties in control of the cyanide copper bath due to the need to maintain the pH of the bath below 10.3 and the free cyanide below 0.25 oz./-gal., as previously described. However, it has been found that when practicing the present invention utilizing (a) a room temperature emulsion alkaline cleaner, (b) a deoxidizing bath including a crystalline, acidic, fluoride-containing salt—e.g., ACTANE®70—and (c), a dilute zincate bath with relatively low zinc concentrations, especially when employing an intermediate prolonged nitric acid soak to further reduce zincate deposition rates, then under such conditions a blister-free tin plated coating can be obtained even when employing a hot alkaline tin bath (see, e.g., Step 17, FIG. 2) and a cyanide copper strike. *For example,* when utilizing a hot alkaline tin bath, satisfactory results have been obtained by depositing a 0.0001" thick cyanide copper strike on the thin zinc protective coating applied in Step 9 (FIG. 3) by immersion in an electroplating bath comprising: water; 40.5 lbs./100 Gal. of sodium cyanide, plating grade, 96-98% NaCN; 25.0 lbs./100 Gal. of sodium carbonate, technical or plating grade, 58% NaOH; 34.5 lbs./100 Gal. of cuprous cyanide, plating grade, 70% copper minimum; and, 50 lbs./Gal. of Rochelle salts (sodium potassium tartrate), technical grade. Thereafter, the substrate is rinsed in cold water and at least 0.002" of acid copper electrodeposited on the cyanide copper strike prior to immersion in the hot alkaline tin bath. Thus, the provision of the acid copper underplate over the cyanide copper strike provides a sufficiently thick non-porous barrier as to preclude solution attack of the substrate by the hot alkaline tin bath.

However, in the practice of the preferred form of the present invention, it has been found that optimum results are obtained when an electroless nickel strike is deposited on the zincate coating as indicated in FIG. 3 in Step 11. Thus, referring to FIGS. 13-15, it will be observed that in the practice of the present invention, excellent uniform adhesion characteristics are obtained between the cast aluminum substrate, zincate coating and electroless nickel strike—i.e., the respective interfaces between the substrate and adjacent plating deposits are essentially devoid of areas of plate separation. Moreover, the electroless nickel strike exhibits excellent throwing power into surface porosities in the porous aluminum casting as evidenced by reference to FIG. 15—this in comparison to the poor throwing power of a cyanide copper strike as evidenced by reference to FIG. 8. It has been found that excellent results are obtained when employing nickel-hypophosphite (90% nickel and 10% phosphorous) in dilute solution—i.e., 75% water and 25% nickel-hypophosphite. While it is believed that most, if not all, commercially available electroless nickel processes may be utilized in the practice of the present invention, particularly advantageous results have been noted when employing an electroless nickel-hypophosphite solution containing 75% water, 18.75% NIPOSIT®65M (NIPOSIT is a registered trademark of the vendor, Shipley Company, Inc., Newton, Mass.), and 6.25% NIPOSIT®R. While this process requires somewhat higher energy consumption then the conventional cyanide copper strike process described in conjunction with FIG. 2—viz., an operating temperature level of 190° F. for 15-20 minutes (FIG. 3, Step 11) as contrasted with an operating temperature level of 130° F. for 7-10 minutes (FIG. 2, Step 15)—and is further slightly more expensive in terms of material costs—viz., approximately 16% more expensive—nevertheless, it is preferred in view of the greatly improved, consistently reproducible adhesion characteristics at the zincate/electroless nickel interface, the greatly improved throwing power into surface porosities in the cast aluminum substrate (Cf., FIG. 8 and FIG. 15), and the relative ease of makeup, operation and control, particularly in the light of the control difficulties encountered when dealing with cyanide copper strikes resulting from the parameters that require control and the operating ranges employed.

It should also be noted that while it is preferred, as hereinbelow described, to utilize a room temperature low pH (pH=1) acid tin plating bath rather than a hot alkaline tin plating bath such as was employed in Step 17 (FIG. 2), nonetheless, blister-free tin plated aluminum castings can be obtained in the practice of one aspect of the present invention when utilizing a hot alkaline tin bath providing steps are taken to insure that the aggressive tin plating solution is prevented from attacking the cast aluminum substrate. This can be effectively accomplished by providing an electroless nickel underplate of 0.00055" thickness or greater, rather than a 0.0001" electroless nickel strike; or, alternatively, by providing an acid copper underplate at least 0.002" thick on a cyanide copper strike in the manner previously described.

D. ROOM TEMPERATURE ACID TIN PLATING

As heretofore indicated, one of the most significant problems encountered when attempting to tin plate porous aluminum castings resides in the aggressive nature of hot alkaline (pH=13) tin plating solutions wherein the solution tends to attack the porous cast aluminum substrate producing excessive accumulations of corrosion products (FIG. 10) and severe etching of the cast aluminum substrate (FIG. 11); both constituting problems which result in severe blistering, peeling and/or flaking of the plated deposits (see, e.g., FIGS. 6 and 7). While the present invention does permit the use of hot alkaline tin baths if a sufficiently thick—e.g., 0.002" or greater—acid copper underplate is deposited on a cyanide copper strike or, if a 0.00055" electroless nickel underplate is employed; nevertheless, in the preferred form of the invention, it is desired to avoid the use of hot alkaline tin baths because of their (i) aggressive nature, (ii) difficulties of control, (iii) high energy consumption, (iv) low plating deposition rate—e.g., 0.0005"/60 minutes, (v) dull, grainy appearance, (vi) relatively high surface contact resistance (63 mhos/in$^2$), and (vii) relatively high cost.

Accordingly, in accordance with one of the important aspects of the present invention—at least when the invention is being employed in a process for tin plating aluminum castings—it is preferred to use a room temperature acid tin bath. Excellent results have been obtained with a bath comprising water, 10 gals. of sulfuric acid (66° Be', O-S-809) per 100 gals. of solution volume, and 35 lbs. stannous sulfate (plating grade) per 100 gals. of solution volume, mechanically agitating the solution for at least 2 hours, filtering to remove stannous sulfate residue, cooling to below 100° F. and, thereafter adding 1 gal. of commercially available brightener and 5 gals. of commercially available carrier per 100 gals. of final solution. *For example,* Stannolume 144 Brightener and Carrier commercially available from M & T Chemicals, Inc., Rahway, N.J., have provided excellent results.

Figure 16:
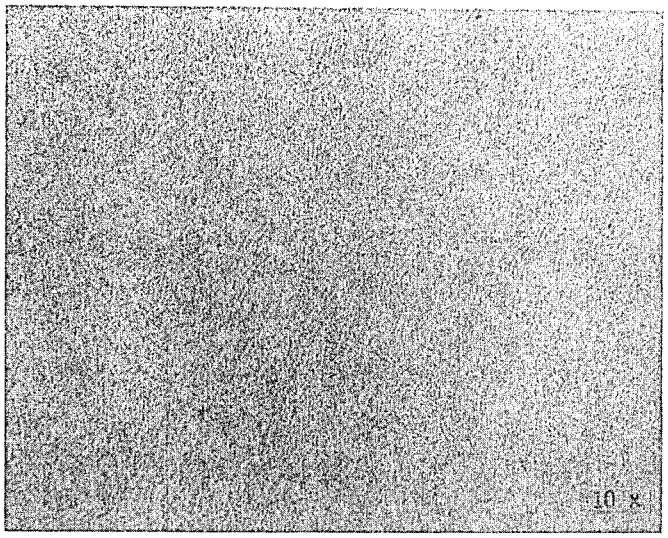
FIG. 16 is a microphotographic view similar to FIG. 6, also at ten-power magnification, but here illustrating the typical blister-free characteristics of tin plating on a machined cast aluminum surface when plated in accordance with the present invention.

Thus, utilizing a room temperature, low pH (pH=1) acid tin bath (Step 13, FIG. 3) has eliminated the tendency to create blistering from plating solution attack of the cast aluminum substrate, tin ($Sn^{+2}$) concentrations are easily controlled by using soluble tin anodes, and energy consumption is substantially reduced when compared with the conventional hot alkaline tin bath process employed at Step 17 (FIG. 2) which required a temperature of 160° F. for 60 minutes. Moreover, plating rates with room temperature acid tin baths are five times greater than experienced with conventional hot alkaline tin baths—viz., 0.0005"/12 minutes versus 0.0005"/60 minutes. As best illustrated in FIG. 16, it will be observed that the resulting plated product exhibits a smooth, fine-grained appearance, devoid of blisters (Cf., FIG. 16 with FIG. 6 and FIGS. 13–15 with FIGS. 8–11). Surface contact resistance is reduced to 84 mhos/in.$^2$. And, material costs when utilizing a room temperature acid tin bath are only about 51% of the material costs incurred with hot alkaline tin baths.

Figure 17:
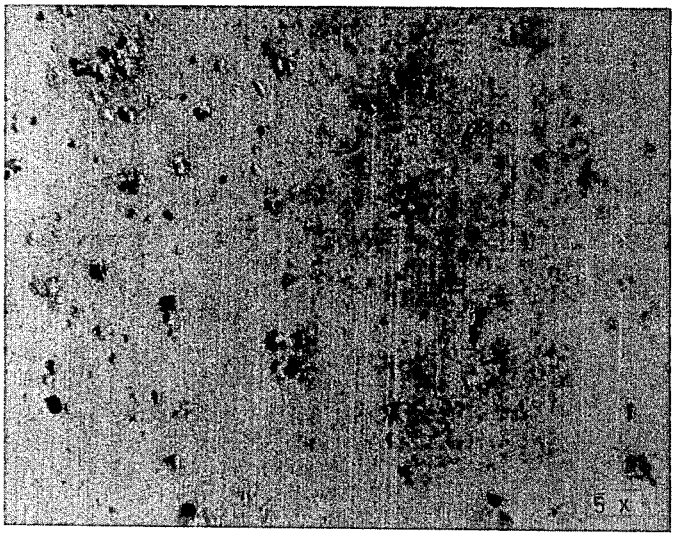
FIGS. 17 (at 5X magnification) and 18 (at 10X magnification) are illustrative of the blister-free tin plating as applied to high porosity aluminum substrates with FIG. 18 particularly illustrating the excellent plating coverage obtained within the substrate porosities.
Figure 18:
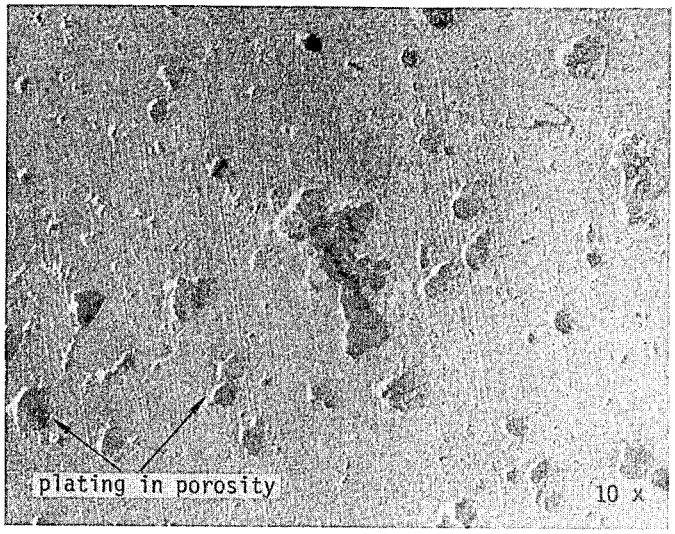

Referring to FIGS. 17 and 18, it will be noted that the foregoing improved tin plating process is highly effective in producing blister-free plates even when dealing with high porosity cast aluminum substrates. Thus, as indicated in FIG. 18 (a photograph illustrating a portion of the surface of the porous casting of FIG. 17 under greater magnification—10X versus 5X), excellent plating coverage is observed even in the substrate porosities. As those skilled in the art will appreciate, when desired, a brightening agent can be added to the room temperature acid tin bath, thereby producing an external tin plating on the aluminum substrate characterized not only by its smooth, fine-grained appearance but, also, by its brightness. While the bright tin finish produced is attractive, nevertheless it does tend to accentuate small surface imperfections. *For example,* as previously described, the use of an activator solution comprising at least about 12 oz./gal. ammoniumbiflouride—which may be supplied by addition of at least 12 oz./gal. ACTANE ®70 powder—in the deoxidizing step (Step 3, FIG. 3) is highly effective in removing surface alloying particles. Removal of such particles tends to leave small cylindrical pits or cavities in the substrate resulting from the particles previously embedded therein, with such pits or cavities commonly having smooth hemispherical bottom surfaces. Such imperfections give the appearance of tiny blisters upon the machined surface of the plated cast aluminum substrate (FIG. 19); but, upon greater magnification (FIG. 20), it is noted that such imperfections are, in fact, plated pits rather than undesired blisters.

E. CORROSION TEST

Figure 21:
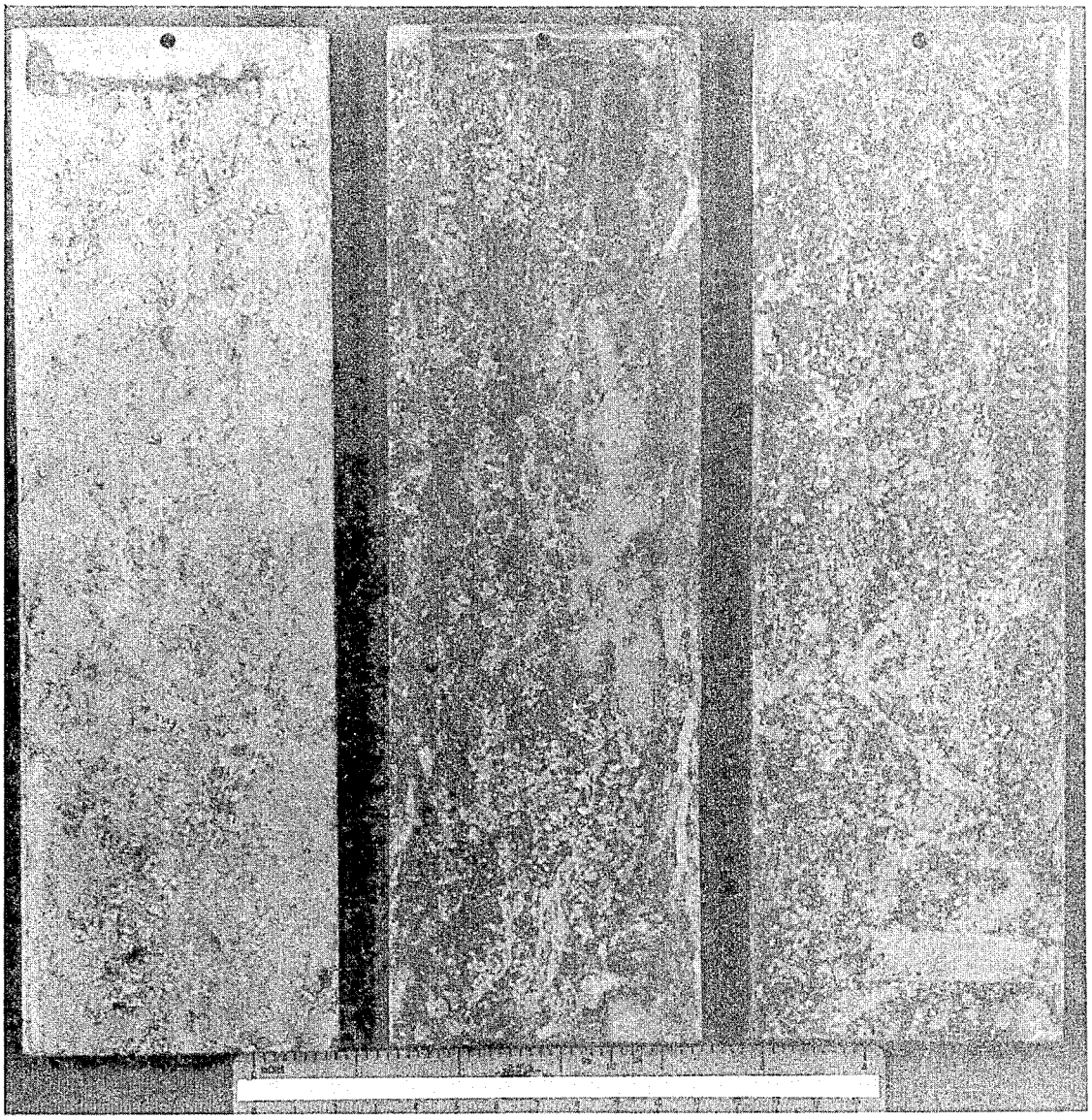
FIG. 21 is a photograph illustrating the poor corrosion resistance characteristics of unplated cast aluminum substrates, with the substrates here being depicted after 24 hours of salt spray exposure.
Figure 22:
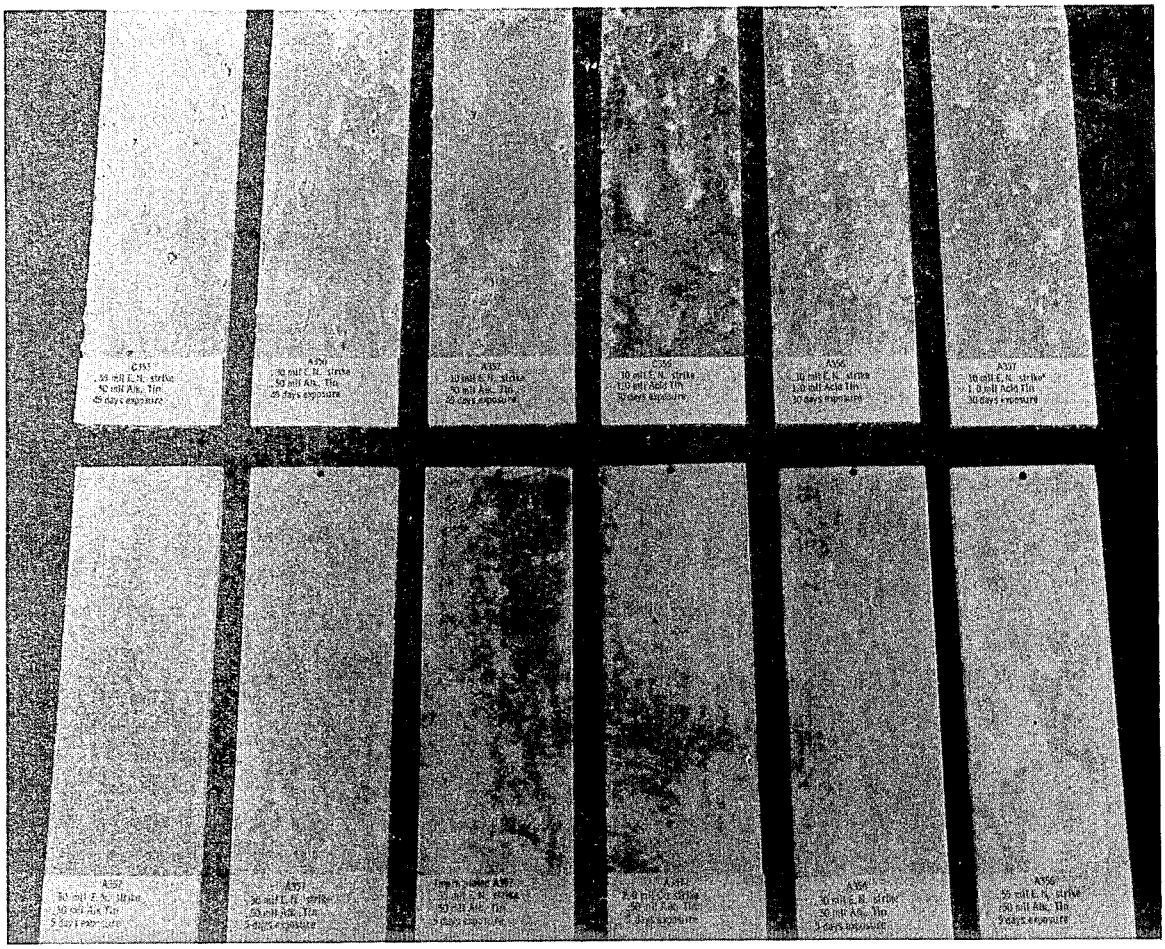
FIG. 22 is a photograph illustrating the improved corrosion resistance characteristics resulting when tin plating cast aluminum substrates in accordance with the present invention even after salt spray exposure for prolonged periods ranging from five days to forty-five days.

In many applications of potential usage of products employing electrodeposited tin, it is necessary that the product meet minimum standards in terms of corrosion resistance. *For example,* one rather stringent standard is that the tin plating produced not exhibit either more than six (6) corroded areas visible to the human eye per square foot of surface area or any corroded area larger than 1/16" after subjection to salt spray for 24 hours. Tin plated porous aluminum castings formed in accordance with the present invention have been found to meet, and greatly exceed, even these stringent corrosion resistance requirements. Thus, as indicated in FIG. 21, unplated C355, A356 and A357 castings exhibit extremely poor corrosion resistance characteristics after subjection to salt spray for 24 hours. However, each of the blister-free coatings hereinabove described—e.g., a 0.0005" tin plate deposited from a room temperature acid tin bath on (i) a 0.0001" electroless nickel strike or on (ii) a 0.0001" cyanide copper strike, and a 0.0005" tin plate deposited from a hot alkaline tin bath on (iii) a 0.002" acid copper underplate over a 0.0001" cyanide copper strike or on (iv) a 0.00055" electroless nickel underplate—when tested under salt spray conditions for 24 hours met and exceeded, such stringent corrosion resistance requirements. Indeed, corrosion did not begin to appear until after five days of salt spray testing and, even after 45 days, no coating failure was detected on non-porous surface areas of the substrate; but, rather, the corroded areas were confined to the original areas of porosity in the casting, thus indicating that the corrosion performance of tin plated aluminum castings made in accordance with the present invention is directly related to the size and extent of surface porosities generated at the foundry, as clearly indicated by examination of the test specimens illustrated in FIG. 22.

In the course of experimentation with the present invention, it was noted that the four step substrate surface activating process comprising Steps 1–4 (FIG. 3) was highly effective in removal of resinous residue when dealing with resin impregnated porous castings such as illustrated in FIG. 12. That is, even when working with resin impregnated porous castings, no blistering was found to result when the surface of the casting was activated in accordance with the invention. Moreover, the present invention was found to be highly effective in providing blister-free plated porous aluminum castings irrespective of whether the porous casting was a quality grade casting or an inferior grade casting. Thus, equally effective results were obtained when plating quality grade castings, such as shown in FIG. 23, having a microstructure characterized by a uniform dispersion of small diameter surface alloying particles and a low density of small diameter surface porosities, and when plating inferior grade castings such as depicted in FIG. 24. Such inferior grade castings have a microstructure characterized by a non-uniform dispersion of large surface alloying particles and/or a relatively high density of large diameter surface porosities.

The improved plating process as herein described has proved to be highly effective, economical, and consistently reproducible even when attempting to plate inferior grade C355, A356 and A357 castings. *For example,* the preferred form of the invention herein described was used to apply a 0.0005" tin plating from a room temperature bright acid tin bath over 0.0001" electroless nickel strike deposited on an ALUMON ®D double zincate protective coating after activation of such inferior grade cast aluminum substrates with a room temperature alkaline emulsion cleaner and deoxidation utilizing ACTANE ®70 deoxidizer. Fifty of such inferior grade castings were tested, each having a machined surface and an "as cast" surface. Yet, notwithstanding the poor grade of the castings tested and, despite the fact the specimens were plated over both machined and "as cast" surfaces, 49 of the 50 test specimens exhibited blister-free plated surfaces after baking for one hour at temperatures ranging from 200° to 225° F.—an extremely high yield when plating any kind of aluminum having a high degree of alloying constituents.

Finally, it should be noted that in addition to producing improved quality plated porous aluminum castings irrespective of the quality of the cast aluminum substrate microstructure, all at higher process rates, with greater yields, and at lower process and material costs, the improved process of the present invention requires a lesser number of process tanks and only one heated tank as contrasted with four heated tanks commonly required with conventional prior art systems, thereby producing substantial savings in terms of energy consumption as well as savings in terms of capital equipment required.

Those skilled in the art will appreciate that the various aspects of the invention have herein been described in terms of processes for plating aluminum substrates, including porous aluminum castings, and plated aluminum substrates produced thereby, having, *for example,* plated deposits of tin 0.0005" thick, and electroless nickel or cyanide copper strikes 0.0001" thick, which are here produced at specified operating temperature ranges and upon immersion in particular plating solutions for specified ranges of time. It will, however, be understood that such plating deposit thickness—except where utilizing a hot alkaline tin plating bath—such operating temperatures, and such immersion periods are given to facilitate an understanding of the preferred forms of the invention and may be varied somewhat dependent upon the specific characteristics desired in the final plated product—e.g., where one desires an outer tin plate greater than 0.0005 thick and/or a non-porous barrier thicker than 0.0001", the operating parameters can be varied somewhat to produce the desired results. Accordingly, it is in the foregoing sense that plating deposit thicknesses, operating temperatures and/or immersion periods have been referred to in certain of the appended claims as "on the order of" a specified operating parameter. On the other hand, where one desires to apply an outer tin plating from a hot alkaline (pH=13) tin bath, it is critical that the non-porous barrier level applied in Step 11 (FIG. 3) comprise: (i) an electroless nickel underplate "at least 0.00055" thick"; or (ii) an electrodeposited copper underplate "at lest 0.002" thick on a cyanide copper strike; or (iii), another plated non-porous barrier characterized by the ability to prevent aggressive solution attack of the substrate in a manner equivalent to that obtained with (i) and (ii) above.

What is claimed is:

1. The process of plating an aluminum substrate comprising the steps of:

(a) cleaning the substrate;

(b) immersing the substrate in a room temperature, low pH, dilute acid bath containing an acidic fluoride-containing salt so as to remove surface contaminants from the substrate while subjecting the substrate to only minimal etching;

(c) immersing the substrate in a first dilute zincate bath having a zinc concentration on the order of 1.1 oz./gal. to apply a first protective coating of zinc thereon;

(d) soaking the substrate in an acid bath for from 1–3 minutes to remove the first protective coating of zinc from the substrate and to apply a uniform oxide coating thereon for reducing subsequent zinc deposition rates;

(e) immersing the substrate in a second dilute zincate bath having a zinc concentration on the order of 1.1 oz./gal. to apply a second protective coating of zinc thereon;

(f) applying a non-porous barrier layer to the second protective coating of zinc by immersion of the zinc coated substrate in a heated bath containing a metal plating solution; and, (g) applying a conductive metal outer plate to the non-porous barrier layer by immersing the substrate in a metal plating bath.

2. The process as set forth in claim 1 wherein the substrate is emulsion cleaned in step (a) by immersion in a room temperature alkaline cleaning solution.

3. The process as set forth in claim 2 wherein the substrate is immersed in the alkaline cleaning solution for a period on the order of at least 10 minutes.

4. The process of claim 1 wherein the room temperature low pH bath comprises a solution of on the order of 25 volume percent water, 25 volume percent nitric acid, 25 volume percent sulfuric acid, and 8–16 oz./gal. of an acidic, fluoride-containing salt.

5. The process as set forth in claim 4 wherein the acidic fluoride-containing salt comprises at least 98% ammoniumbifluoride.

6. The process as set forth in claim 4 wherein the substance is immersed in the room temperature, low pH bath for a period on the order of 9–15 minutes.

7. The process as set forth in claim 4 wherein the substrate etch rate in step (b) is maintained at a relatively low rate on the order of 0.9 mil/surface/hr.

8. The process as set forth in claims 1, 2, 3, 4, 5, 6 or 7 wherein the acid bath employed in step (d) is nitric acid.

9. The process as set forth in claims 1, 2, 4 or 5 wherein the substrate is immersed in the first dilute zincate bath for a period on the order of 20–45 seconds and in the second dilute zincate bath for a period on the order of 5–30 seconds.

10. The process as set forth in claims 1, 2, 4 or 5 wherein the non-porous barrier layer applied in step (f)

comprises an electroless nickel strike on the order of 0.0001" thick deposited on the substrate by immersion in a nickel-hypophosphite bath containing on the order of 75 volume percent water and 25 volume percent nickel-hypophosphite.

11. The process as set forth in claims 1, 2, 4 or 5 wherein the non-porous barrier layer applied in step (f) comprises an electroless nickel strike on the order of 0.0001" thick deposited on the substrate by immersion in a nickel-hypophosphite bath containing on the order of 75 volume percent water and 25 volume percent nickel-hypophosphite and maintained at a temperature on the order of 190° F.

12. The process as set forth in claims 1, 2, 4 or 5 wherein the non-porous barrier layer applied in step (f) comprises a cyanide copper strike on the order of 0.0001" thick electrolytically deposited on the substrate by immersion in a cyanide copper strike solution for a period of from 7–10 minutes and wherein the cyanide copper strike solution is maintained at a temperature on the order of 130° F.

13. The process as set forth in claims 1, 2, 4 or 5 wherein the non-porous barrier layer applied in step (f) comprises a cyanide copper strike on the order of 0.0001" thick electrolytically deposited on the substrate by immersion in a cyanide copper strike solution maintained at a temperature on the order of 130° F. for a period of from 7–10 minutes and an acid copper underplate on the order of at least 0.002" thick deposited on the cyanide copper strike, and wherein the conductive metal plate applied to the non-porous barrier layer in step (g) comprises a tin plate on the order of 0.0005" thick deposited on the acid copper underplate by immersion for a period of on the order of 60 minutes in a hot alkaline tin plate bath maintained at a temperature on the order of 160° F.

14. The process as set forth in claims 1, 2, 4 or 5 wherein the conductive metal plate applied to the non-porous barrier layer in step (g) is applied by immersion in a room temperature, low pH, acid tin bath.

15. The process as set forth in claims 1, 2, 4, 5 or 7 wherein the aluminum substrate is a porous aluminum substrate.

16. The process as set forth in claims 1, 2, 4, 5, or 7 wherein the aluminum substrate is a cast porous aluminum substrate.

17. The plated porous aluminum product formed by the process as set forth in claim 15 and characterized by the absence of plating separations and blisters.

18. The plated cast porous aluminum product formed by the process as set forth in claim 16 and characterized by the absence of plating separations and blisters.

* * * * *